US009305479B2

(12) United States Patent
Chu et al.

(10) Patent No.: US 9,305,479 B2
(45) Date of Patent: Apr. 5, 2016

(54) DETECTION CIRCUIT FOR DARK POINT ON PANEL

(71) Applicants: BOE TECHNOLOGY GROUP CO., LTD., Beijing (CN); CHENGDU BOE OPTOELECTRONICS TECHNOLOGY CO., LTD., Chengdu (CN)

(72) Inventors: Zhengyong Chu, Beijing (CN); Se Hyuck Park, Beijing (CN); Chuanxiong Chen, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 70 days.

(21) Appl. No.: 14/069,479

(22) Filed: Nov. 1, 2013

(65) Prior Publication Data

US 2014/0125646 A1 May 8, 2014

(30) Foreign Application Priority Data

Nov. 2, 2012 (CN) ..... 2012 1 0434566

(51) Int. Cl.

| | |
|---|---|
| ***G09G 5/00*** | (2006.01) |
| ***G09G 3/00*** | (2006.01) |
| ***G09G 3/36*** | (2006.01) |

(52) U.S. Cl.

CPC ..... *G09G 3/006* (2013.01); *G09G 3/3607* (2013.01)

(58) Field of Classification Search

CPC ..... G09G 3/00; G09G 3/006; G09G 3/36; G09G 3/3607

USPC ..... 345/87–100, 204–215

See application file for complete search history.

(56) References Cited

U.S. PATENT DOCUMENTS

| | | | | |
|---|---|---|---|---|
| 5,608,558 | A | 3/1997 | Katsumi | |
| 7,009,678 | B2 * | 3/2006 | Yamahara et al. | 349/181 |

(Continued)

FOREIGN PATENT DOCUMENTS

| | | | |
|---|---|---|---|
| CN | 1928963 | A | 3/2007 |
| CN | 101661169 | A | 3/2010 |
| CN | 201804530 | U | 4/2011 |

OTHER PUBLICATIONS

Second Office Action (Chinese language), issued by State Intellectual Property Office of P.R.C., on Apr. 8, 2015 for Chinese Application No. 201210434566.6, 6 pages.

English translation of Second Office Action (listed above), issued by State Intellectual Property Office of P.R.C., on Apr. 8, 2015 for Chinese Application No. 201210434566.6, 5 pages.

English abstract of CN201804530U, listed above, 1 page.

English abstract of CN1928963A, listed above, 1 page.

First Office Action (Chinese language) issued by the State Intellectual Property Office ("SIPO") on Nov. 3, 2014 for International Application No. 201210434566.6, 6 pages.

English translation of first Office Action (listed above), issued by SIPO on Nov. 3, 2014 for International Application No. 201210434566.6, 6 pages.

Third Chinese Office Action dated Aug. 6, 2015; Appln. No. 201210434566.6.

*Primary Examiner* — Vijay Shankar

(74) *Attorney, Agent, or Firm* — Ladas & Parry LLP

(57) ABSTRACT

Provided is a detection circuit for dark points on a panel, comprising a preset voltage generation module and a selection circuit module, wherein the preset voltage generation module is connected with the selection circuit module and is used for transferring N preset voltages to the selection circuit module, and the selection circuit module comprises N inputting terminals for receiving the N preset voltages, respectively, an outputting terminal and a strobe switch for strobing the outputting terminal with one of the N inputting terminals, N≥2. The circuit according to the embodiments of the present disclosure can detect the dark point defect caused by remains in active layers effectively in a panel state and prevent the panels having such dark point defects from being incorporated into modules, so that a waste of cost is avoid and a detection capability in a detection procedure for the panel is increased.

9 Claims, 2 Drawing Sheets

(56) References Cited

U.S. PATENT DOCUMENTS

| | | | | |
|---|---|---|---|---|
| 7,180,530 | B2 * | 2/2007 | Whittington et al. | 345/690 |
| 7,205,974 | B2 * | 4/2007 | Pasqualini et al. | 345/102 |
| 2004/0196276 | A1 * | 10/2004 | Arai et al. | 345/204 |
| 2005/0062704 | A1 * | 3/2005 | Whittington et al. | 345/89 |
| 2007/0052655 | A1 | 3/2007 | Ozaki et al. | |
| 2009/0140709 | A1 * | 6/2009 | Dong et al. | 323/283 |
| 2010/0056008 | A1 | 3/2010 | Li et al. | |
| 2014/0104557 | A1 * | 4/2014 | Suzuki | 349/143 |
| 2014/0139322 | A1 * | 5/2014 | Wang et al. | 340/10.5 |

* cited by examiner

DETECTION CIRCUIT FOR DARK POINT ON PANEL

CROSS REFERENCE TO RELATED APPLICATIONS

This application claims priority from Chinese National Application No. 201210434566.6 filed on Nov. 2, 2012, the contents of which are incorporated herein by reference.

TECHNICAL FIELD

The present disclosure relates to a field of display technique, and particularly, to a detection circuit for dark points on a panel.

BACKGROUND

Currently, as a core technique for a wide viewing angle in a plate electric field, an Advanced Super Dimension Switch (ADS) may improve a picture quality of a TFT-LCD product, and has advantages of a high resolution, a high transmittance, a low power consumption, a high aperture ratio, a low chromatism, no push mura, etc. However, remains in active layers may be generated during a manufacturing process of an array substrate, and may lead to more point defects after a liquid crystal cell is formed. Such remains are slight as being observed by a microscope in macroscopic, but the dark point defects caused by the remains would prominent more intuitively as compared with a TN (Twisted Nematic) type. The dark point phenomenon is very slight in a panel state formed after a panel-cutting process but is clearer in a module state. Therefore, such dark points are not easy to be detected in the panel state, such that the panel having the dark point defects is incorporated into a module, which may produce many unqualified products and increase cost unnecessarily.

SUMMARY

Problems to be Solved

A problem to be solved by embodiments of the present disclosure is how to detect dark point defects caused by remains effectively in a panel state.

Solutions of the Invention

To solve the problem described above, in embodiments of the present disclosure, there is provided a detection circuit for dark points on a panel comprising a preset voltage generation module and a selection circuit module, wherein the preset voltage generation module is connected with the selection circuit module and is used for transferring N preset voltages generated to the selection circuit module, and the selection circuit module comprises N inputting terminals for receiving the N preset voltages, respectively, an outputting terminal and a strobe switch for strobing the outputting terminal with one of the N inputting terminals, N≥2.

Optionally, the preset voltage generation module comprises a microcontroller, a D/A convertor and N operational amplifiers, the microcontroller is connected with the D/A convertor and is used for transmitting N digital voltage signals to the D/A convertor, the D/A convertor converts the N digital voltage signals into N analog signals and transmits the N analog signals to the N operational amplifiers, respectively, and the N operational amplifiers are connected with the N inputting terminals of the selection circuit module, respectively, and are used for transmitting the amplified N analog signals to the selection circuit module.

Optionally, the preset voltage generation module is used for transferring two preset voltages generated to the selection circuit module, and the selection circuit module comprises two inputting terminals for receiving the two preset voltages, respectively, an outputting terminal and a strobe switch for strobing the outputting terminal with one of the two inputting terminals.

Optionally, the preset voltage generated by the preset voltage generation module is a gate high level voltage being lower than an original gate high level voltage when the panel operates normally.

Optionally, the original gate high level voltage when the panel operates normally is an original gate high level voltage when an ADS panel shows a normal L63 picture. The gate high level voltage generated by the preset voltage generation module is 0~5V, and the detection circuit for dark points on the panel selects the gate high level voltage when an input voltage is the original gate high level voltage.

Optionally, the preset voltage generated by the preset voltage generation module is a gate low level voltage being lower than or equal to an original gate low level voltage when the panel operates normally.

Optionally, the original gate low level voltage when the panel operates normally is an original gate low level voltage when an ADS panel shows a normal L63 picture. The gate low level voltage generated by the preset voltage generation module is −10V~−13V, and the detection circuit for dark points on the panel selects the gate low level voltage when an input voltage is the original gate low level voltage.

Optionally, the preset voltage generation module comprises a microcontroller, a D/A convertor and two operational amplifiers, the microcontroller is connected with the D/A convertor and is used for transmitting two digital voltage signals to the D/A convertor, the D/A convertor converts the two digital voltage signals into two analog signals and transmits the two analog signals to the two operational amplifiers, respectively, and the two operational amplifiers are connected with the two inputting terminals of the selection circuit module, respectively, and are used for transmitting the amplified two analog signals to the selection circuit module.

Optionally, the selection circuit module is an analog switch.

Optionally, the selection circuit module comprises a N-type MOS transistor and a P-type MOS transistor, wherein one terminal, not being a gate, of the N-type MOS transistor is connected with a first operational amplifier, one terminal, not being a gate, of the P-type MOS transistor is connected with a second operational amplifier, the other terminal, not being the gate, of the N-type MOS transistor is connected with the other terminal, not being the gate, of the P-type MOS transistor so as to form the outputting terminal, the gate of the N-type MOS transistor is connected with the gate of the P-type MOS transistor so as to receive an input voltage, the N-type MOS transistor and the P-type MOS transistor form the strobe switch.

Benefit Effects

The detection circuit for dark points on a panel according to the embodiments of the present disclosure makes a dark point defect being slight specially in the panel evolve to a clear light point defect and be prominent effectively by selecting and applying a suitable preset voltage to gate lines of the panel according to an input voltage signal, thus the dark points caused by the remains may be detected easily in the panel state, which may effectively prevent panels having defects from being incorporated into modules, and in turn may save a cost and increase a qualified rate of products

DETAILED DESCRIPTION

Implementations of the present disclosure will be described in detail below in connection with drawings and embodiments. Following embodiments are provided only to illustrate the present disclosure, but not to limit a scope of the present disclosure.

Embodiment 1

Figure 1:
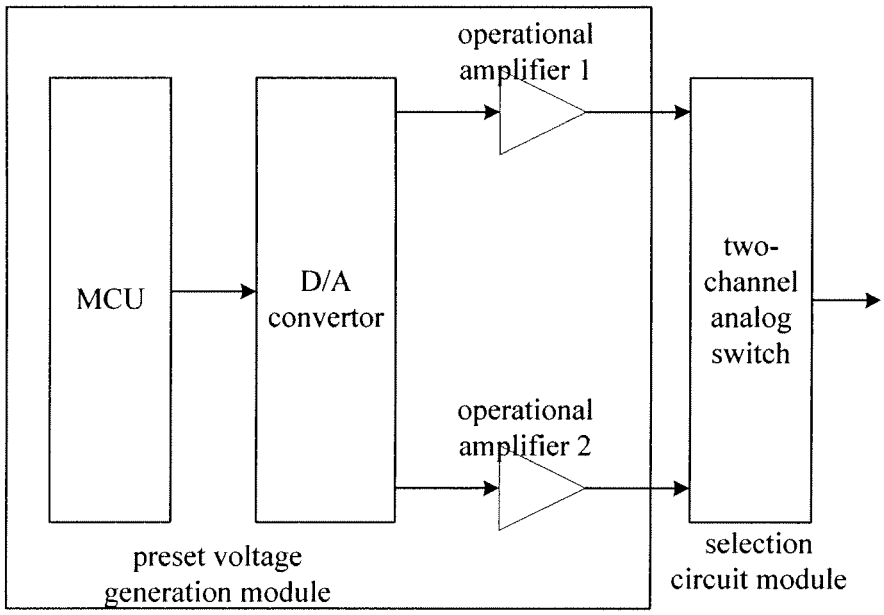
FIG. 1 is an exemplary structural diagram of a detection circuit for dark points on a panel, providing two preset voltages, according to an embodiment of the present disclosure.

In this embodiment, a detection circuit for dark points on a panel according to the embodiment of the present disclosure is explained by means of an example wherein two preset voltages are provided. As illustrated in FIG. 1, the detection circuit for dark points on a panel comprises a preset voltage generation module and a selection circuit module. The preset voltage generation module is connected with the selection circuit module and is used for transferring two preset voltages generated to the selection circuit module. The selection circuit module comprises two inputting terminals for receiving the two preset voltages, respectively, an outputting terminal and a strobe switch for strobing the outputting terminal with one of the two inputting terminals.

The preset voltage generation module in this embodiment comprises a microcontroller MCU, a D/A convertor and two operational amplifiers (an operational amplifier 1 and an operational amplifier 2), and the selection circuit module is a two-channel analog switch. The two-channel analog switch is device for switching or selecting signals, and generally comprises two inputting terminals, one outputting terminal and a strobe switch for selecting one of the two inputting terminals to be connected with the outputting terminal under the control of an external signal. The MCU is connected with the D/A convertor, the D/A convertor is connected with the two operational amplifiers, and the two operational amplifiers are connected with the two inputting terminal of the two-channel analog switch, respectively.

In operation, two predetermined gate voltages, that is, preset voltage values, are set by a MCU embedded program, and the preset voltage values exist in a form of digital voltage signals in the MCU. The MCU transmits the two preset digital voltage signals to the D/A convertor, the D/A converter performs a digital-analog conversion and transmits the two converted analog signals to the operational amplifier 1 and the operational amplifier 2, respectively, and the two preset voltages reach voltage values predetermined previously after being amplified and output from the operational amplifier 1 and the operational amplifier 2, respectively. The two operational amplifiers transmit the two preset voltages to the two inputting terminals of the two-channel analog switch, respectively, and the two-channel analog switch selects one of the two inputting terminals to be connected with the outputting terminal according to a voltage value originally input to a gate line and inputs the preset voltage corresponding to the selected inputting terminal to the gate line on the panel.

Regarding an ADS panel, taking an ADS product of 2.83 inches as an example, by applying a H/F (row conversion) mode to a normal L63 picture (a gray picture, when the ADS product uses a normal-black mode driving manner), a special L63 picture (L00: a white picture after voltage is changed) is generated, the special L63 picture's gray scale is 255, and forming conductions for the special L63 picture are as follows: a $V_{gh}$ (a gate high level) is 0~5V; a $V_{gl}$ (a gate low level) is −10V; a R G B/H (a red, green, blue sub-pixel high level) is 4.50; a R G B/L (a red, green, blue sub-pixel low level) is 0.5; a $V_{com}$/H (a common electrode high level) is 3.20V; a $V_{com}$/L (a common electrode low level) is −1.04V. That is, the two preset voltages are 0~5V and −10~−13V, and input voltages for the original normal L63 picture are panel gate voltages $V_{gh}/V_{gl}$ of 15V/−10V. With a conversion in the circuit illustrated in FIG. 1, the preset voltage of 0~5V may be selected if an original gate high level of the original L63 picture is 15V, and the preset voltage of −10~−13V may be selected if the original gate low level of the original L63 picture is −10V, so that the replaced high level 0~5V or low level −10~−13V is input to gate lines on the panel to be detected. Because of variations in voltages input to the gate lines, RGB sub-pixels become being undercharged after a turn-on voltage of the gate high level decreases, and the defect described above is further deteriorated in this undercharging manner, so that the defect which is slight and unobvious originally becomes serious. In other words, the dark point defect being slight specially evolves a clear light point defect and is prominent effectively by means of enhancing a luminance difference between an abnormal position and a normal position, thus the dark points may be detected easily in the panel state, which may effectively prevent panels having defects from being incorporated into modules, and in turn may save a cost and increase a qualified rate of products.

Embodiment 2

Figure 2:
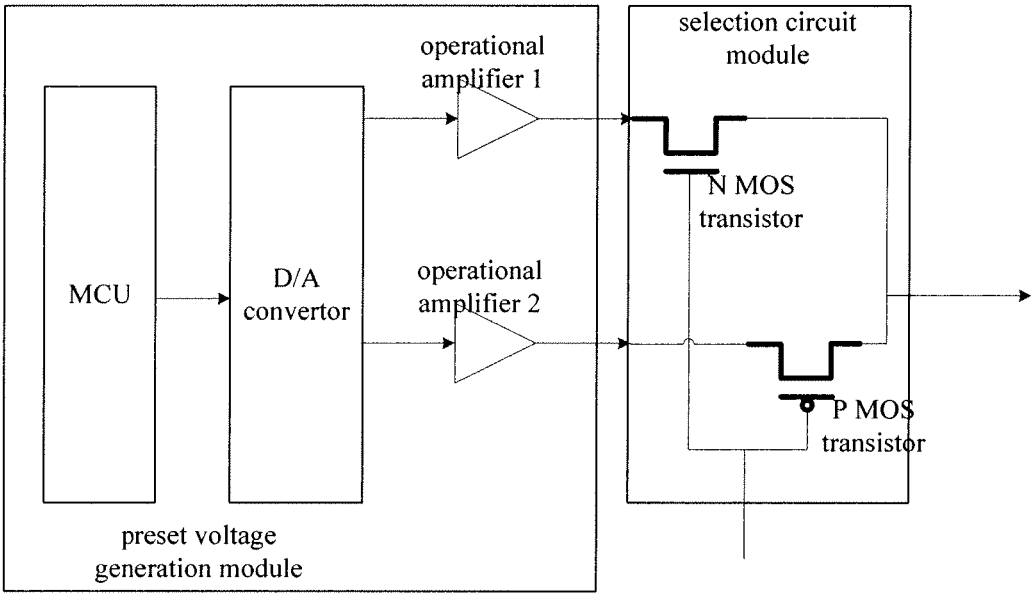
FIG. 2 is an exemplary structural diagram of a detection circuit for dark points on a panel, providing two preset voltages, according to another embodiment of the present disclosure.

A detection circuit for dark points on a panel according to this embodiment has a substantive same circuit structure as that of the Embodiment 1, other than a different selection circuit module used. As illustrated in FIG. 2, the selection circuit module according to this embodiment comprises a N-type MOS transistor and a P-type MOS transistor. A gate of the N-type MOS transistor is connected with a gate of the P-type MOS transistor so as to form a strobe switch for receiving an original gate line voltage. One terminal, not being the gate, of the N-type MOS transistor is connected with one terminal, not being the gate, of the P-type MOS transistor so as to form an outputting terminal. The other terminal, not being the gate, of the N-type MOS transistor is connected with an operational amplifier 1, and the other terminal, not being the gate, of the P-type MOS transistor is connected with an operational amplifier 2.

Taking the ADS product of 2.83 inches as an example also, an input voltage (an original gate voltage on a panel: $V_{gh}/V_{gl}$) is 15V/−10V, therefore the N-type MOS transistor is turned on when the input voltage is 15V and a voltage of 0~5V output from the operational amplifier 1 is input to the gate line on the panel; the P-type MOS transistor is turned on when the input voltage is −10V and a voltage of −10~−13V output from the operational amplifier 2 is input to the gate line on the panel. Thus, a selection of preset voltages is implemented.

A structure of the preset voltage generation module and a principle for realizing a dark point detection according to this embodiment are same as those of Embodiment 1, so details are omitted herein.

Embodiment 3

Figure 3:
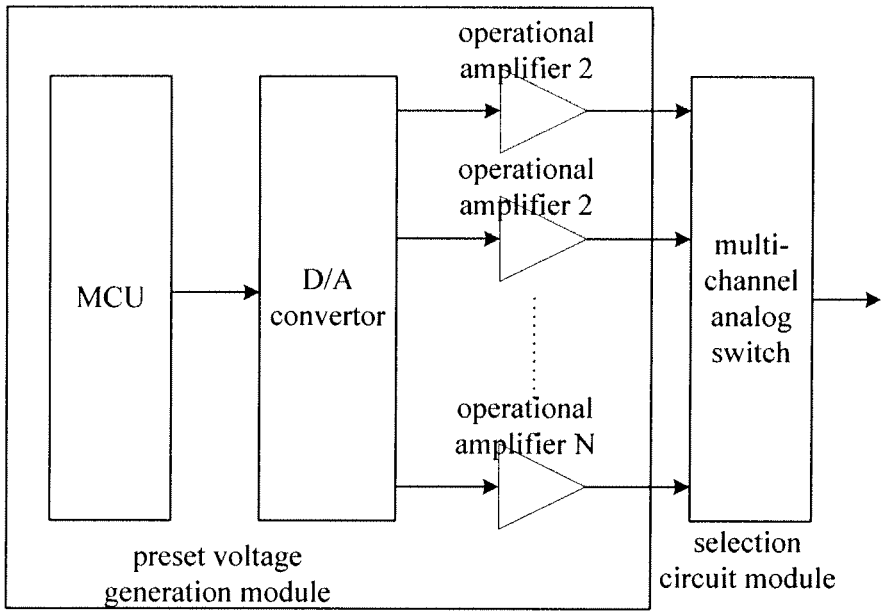
FIG. 3 is an exemplary structural diagram of a detection circuit for dark points on a panel according to the embodiments of the present disclosure.

In this embodiment, there is provided a detection circuit for dark points on a panel implementing a plurality preset voltages. As illustrated in FIG. 3, the preset voltage generation module comprises N operational amplifiers, and the selection circuit module is a multi-channel (N-channel) analog switch. A MCU is used for transmitting N digital voltage signals to the D/A convertor, the D/A convertor converts the N digital voltage signals into N analog signals and transmits the N analog signals to the N operational amplifiers, respectively, and the N operational amplifiers are connected with N inputting terminals of the multi-channel analog switch, respectively, and are used for transmitting the amplified N analog signals to the multi-channel analog switch. The multi-channel analog switch selects and output a different preset voltage according to an original gate line voltage.

The embodiments of the disclosure being thus described are only illustrative but not limitations for the present disclosure, it will be obvious that the same may be varied in many ways. Such variations are not to be regarded as a departure from the spirit and scope of the disclosure, and all such modifications as would be obvious to those skilled in the art are intended to be included within the scope of the following claims.

What is claimed is:

1. A detection circuit for detecting an Advanced Super Dimension Switch (ADS) display panel, comprising a preset voltage generation module and a N channel analog switch comprising N inputting terminals and an outputting terminal, wherein the preset voltage generation module comprises N operational amplifiers which are connected to the N inputting terminals of the N channel analog switch respectively, and are used for generating N preset analog voltages and transferring the N preset analog voltages generated to the N inputting terminals of the N channel analog switch respectively, N≥2, the N channel analog switch selects and outputs one of the N preset analog voltages according to an original gate line voltage.

2. The detection circuit of claim 1, wherein the preset voltage generation module further comprises a microcontroller and a D/A convertor, the microcontroller is connected with the D/A convertor and is used for transmitting N digital voltage signals to the D/A convertor, the D/A convertor converts the N digital voltage signals into N analog signals and transmits the N analog signals to the N operational amplifiers, respectively, and the N operational amplifiers are used to amplify the N analog signals to obtain the N preset analog voltages.

3. The detection circuit of claim 1, wherein the preset voltage generation module is used for transferring two preset analog voltages generated to the N channel analog switch, and the N channel analog switch comprises two inputting terminals for receiving the two preset analog voltages, respectively, and selects and outputs one of the two preset analog voltages according to the original gate line voltage.

4. The detection circuit of claim 1, wherein the preset analog voltage generated by the preset voltage generation module is a gate high level voltage being lower than an original gate high level voltage when the panel operates normally.

5. The detection circuit of claim 4, wherein the original gate high level voltage when the panel operates normally is an original gate high level voltage when the ADS display panel shows a normal L63 picture, the gate high level voltage generated by the preset voltage generation module is 0~5V, and the detection circuit selects the gate high level voltage when an input voltage is the original gate high level voltage.

6. The detection circuit of claim 1, wherein the preset analog voltage generated by the preset voltage generation module is a gate low level voltage being lower than or equal to an original gate low level voltage when the panel operates normally.

7. The detection circuit of claim 6, wherein the original gate low level voltage when the panel operates normally is an original gate low level voltage when the ADS display panel shows a normal L63 picture, the gate low level voltage generated by the preset voltage generation module is −10V~−13V, and the detection circuit selects the gate low level voltage when an input voltage is the original gate low level voltage.

8. The detection circuit of claim 3, wherein the N operational amplifiers are two operational amplifiers, and the preset voltage generation module further comprises a microcontroller and a D/A convertor, the microcontroller is connected with the D/A convertor and is used for transmitting two digital voltage signals to the D/A convertor, the D/A convertor converts the two digital voltage signals into two analog signals and transmits the two analog signals to the two operational amplifiers, respectively, and the two operational amplifiers are used to amplify the two analog signals to obtain the two preset analog voltages.

9. The detection circuit of claim 3, wherein the N channel analog switch comprises a N-type MOS transistor and a P-type MOS transistor, wherein one terminal, not being a gate, of the N-type MOS transistor is connected with a first operational amplifier, one terminal, not being a gate, of the P-type MOS transistor is connected with a second operational amplifier, the other terminal, not being the gate, of the N-type MOS transistor is connected with the other terminal, not being the gate, of the P-type MOS transistor so as to form the outputting terminal, the gate of the N-type MOS transistor is connected with the gate of the P-type MOS transistor so as to receive an input voltage.

* * * * *